US005301812A

United States Patent [19]

Garrett et al.

[11] Patent Number: 5,301,812

[45] Date of Patent: Apr. 12, 1994

[54] AIR CLASSIFYING APPARATUS WITH WEAR REDUCING DEFLECTOR

[75] Inventors: Harvey M. Garrett, Sandersville; George M. Johnson, Tennille, both of Ga.

[73] Assignee: ECC International Inc., Atlanta, Ga.

[21] Appl. No.: 42,040

[22] Filed: Apr. 2, 1993

[51] Int. Cl.[5] ..... B07B 5/12; B07B 7/083

[52] U.S. Cl. ..... 209/714

[58] Field of Search ..... 209/21, 28, 133, 138, 209/139.1, 139.2, 142, 143, 144, 148, 154

[56] References Cited

U.S. PATENT DOCUMENTS

| | | | |
|---|---|---|---|
| 1,214,249 | 1/1917 | Williams | 209/144 |
| 1,953,058 | 4/1934 | Andrews et al. | 209/143 |
| 2,774,476 | 10/1954 | Doyle | 209/139.2 |
| 2,968,401 | 1/1961 | Sheldon | 209/144 |
| 4,260,478 | 4/1981 | Hosokawa et al. | 209/139.2 |
| 4,673,134 | 6/1987 | Barthelmess | 241/57 |
| 5,120,431 | 6/1992 | Cordonnier | 209/144 X |

FOREIGN PATENT DOCUMENTS

| | | | |
|---|---|---|---|
| 1554995 | 4/1990 | U.S.S.R. | 209/139.2 |
| 1632516 | 3/1991 | U.S.S.R. | 209/139.2 |

*Primary Examiner*—D. Glenn Dayoan
*Assistant Examiner*—Tuan N. Nguyen
*Attorney, Agent, or Firm*—Klauber & Jackson

[57] ABSTRACT

Improvements are disclosed in apparatus for air classifying mineral particles by size. The apparatus is of the type including a vertically oriented flow channel for carrying an upwardly directed air flow stream in which the particles are dispersed and a cylindrical air classifier mounted in the flow channel. The classifier has a cage which is rotatable about a vertical axis and is laterally open to the flow channel. A plurality of spaced vertical rejector blades are mounted about the lateral periphery, and the cage is closed at its lower end by a support plate. An outlet is connected to the classifier interior for withdrawing particles passing radially through the blades for collection; and air drawing device is connected to the outlet for drawing the air stream and particles into the classifier and establishing an upward flow of air and dispersed particles within channel. The improvement prevents or limits damage of the classifier support plate by the abrasive impact of the particles carried by the upward flow. A hollow funnel-shaped deflector is fixedly secured below the classifier with its tip facing downwardly. The deflector is open at its base, and formed thereat into an axially-extending lip, the inside of which surrounds but is slightly spaced from the lateral edge of the face plate. An outward air flow is induced through the space between the support plate edge and the deflector lip. This provides an air seal preventing particles from entering the interior of the deflector where they can interfere with the rotation of the classifier or damage the support plate.

10 Claims, 2 Drawing Sheets

AIR CLASSIFYING APPARATUS WITH WEAR REDUCING DEFLECTOR

BACKGROUND OF THE INVENTION

This invention relates generally to vertical blade rotary air classifying and separating apparatus. Such devices are used to classify and separate particles (such as mineral particles) according to their size, and produce separate discharges of coarse and fine particulate materials. More specifically the invention relates to an improvement in such apparatus, wherein a deflector is incorporated into same to reduce wear to the rotor and associated components caused by abrasive impact with air entrained feed materials.

Vertical blade rotary air classifiers are well known to industry for use in separating dry granular materials (such as minerals) according to particle size. In a typical configuration, dry granular material is entrained in an air stream induced by a fan arrangement, and the entrained material is presented to a vertical blade rotary rejector. The entrained fine fraction of the material passes through the rotating vertical blade rejector to a conduit which directs it to a collection device. The coarse fraction of the materials is prevented from passing through the rotary rejector by impact with the vertical rejector blades, and is forced away for collection or for further processing.

Collision of the entrained feed material with the rotating vertical rejector blades subjects the component parts of the rejector cage to severe abrasion. The vertical blades and the lower rotor support section of the vertical blade rotary rejector cage are subjected to the most severe abrasion. In the past this abrasion problem in respect to the rotor rejector blades has typically been addressed by constructing the blades from an abrasion resistant material, or by coating the leading side of the blades with an abrasion resistant material. The abrasion problem in respect to the bottom support members of the rotating rejector cage has typically been addressed by attaching some type of protecting shield or deflector to the bottom support member of the rotor to protect the components in the lower part of the rotor from the effects of material abrasion. Since, however, this type of shield rotates with the rotor, the abrasion problem is shifted from the lower rotor to the rotating deflector. If the wear is not detected and holes are allowed to develop in the rotating deflector, material will enter the deflector cavity, lodge against the inside walls of same and upset the balance of the rotating assembly of the classifier. Rotating deflectors also impart centrifugal force to particles colliding with them. This centrifugal force drives the particles against the wall of the classifying chamber and back into the rotating rejector blades causing abrasive wear to the blades.

In accordance with the foregoing, it may be regarded an object of the present invention, to provide an improved air classifying apparatus of the type utilizing vertical blade rotors, which is effective in preventing or limiting damage of the downwardly facing rotor support plate.

SUMMARY OF INVENTION

Now in accordance with the present invention, the foregoing object, and others as will become apparent in the course of the ensuing specification are achieved in improvements which are applicable to apparatus for air classifying particles by size characteristics, which is of the type including a vertically oriented flow channel for carrying an upwardly directed air flow stream in which the feed particles are dispersed; a cylindrical air classifier mounted in the flow channel for rotation about a vertical axis, the classifier having a plurality of spaced vertical rejector blades mounted about its lateral periphery, and being substantially closed at its lower end by a support plate; the classifier having an outlet connected to its interior for enabling particles passing radially through the blades to be withdrawn for collection; and air suction means connected to the classifier outlet for drawing the air stream and dispersed particles into the classifier and thereby establishing the upward flow of air stream and dispersed particles within the said flow channel.

Pursuant to the invention, damage of the classifier support plate by the abrasive impact of the feed particles carried by the upwardly flowing air stream flow is precluded or limited by means of a hollow generally frusto-conically shaped deflector which is fixedly mounted in the flow channel below the classifier with its apex facing downwardly. The deflector is open at its base, and has a cylindrical wall or lip at its base, the inside of which surrounds but is spaced from the lateral edge of the support plate and from the interior wall of the flow channel. Means are provided for introducing an air flow into the hollow interior of the deflector at a pressure exceeding that in the flow channel, to thereby effect an outward air flow through the space between the support plate edge and the cylindrical lip, to provide an air seal preventing particles from entering the interior of the deflector where they can interfere with the rotation of the classifier or damage the support plate by impact therewith.

The means for introducing an air flow into the hollow interior of the deflector can comprise one or more conduits connecting the deflector interior to atmosphere.

The means for introducing the air flow into the hollow interior of the deflector can also comprise means for generating a forced air flow into the deflector interior.

The one or more conduits can include adjustable valve means for regulating the air flow into the deflector interior.

The conduit means can also comprise a plurality of hollow tubular members, each of which intersects with an opening in the lateral wall of the deflector and at its distal end communicates with atmosphere. The tubular members can also serve to support the deflector within the flow channel for the feed.

BRIEF DESCRIPTION OF DRAWINGS

The invention is diagrammatically illustrated, by way of example, in the drawings appended hereto, in which.

DESCRIPTION OF PREFERRED EMBODIMENTS

Figure 1:
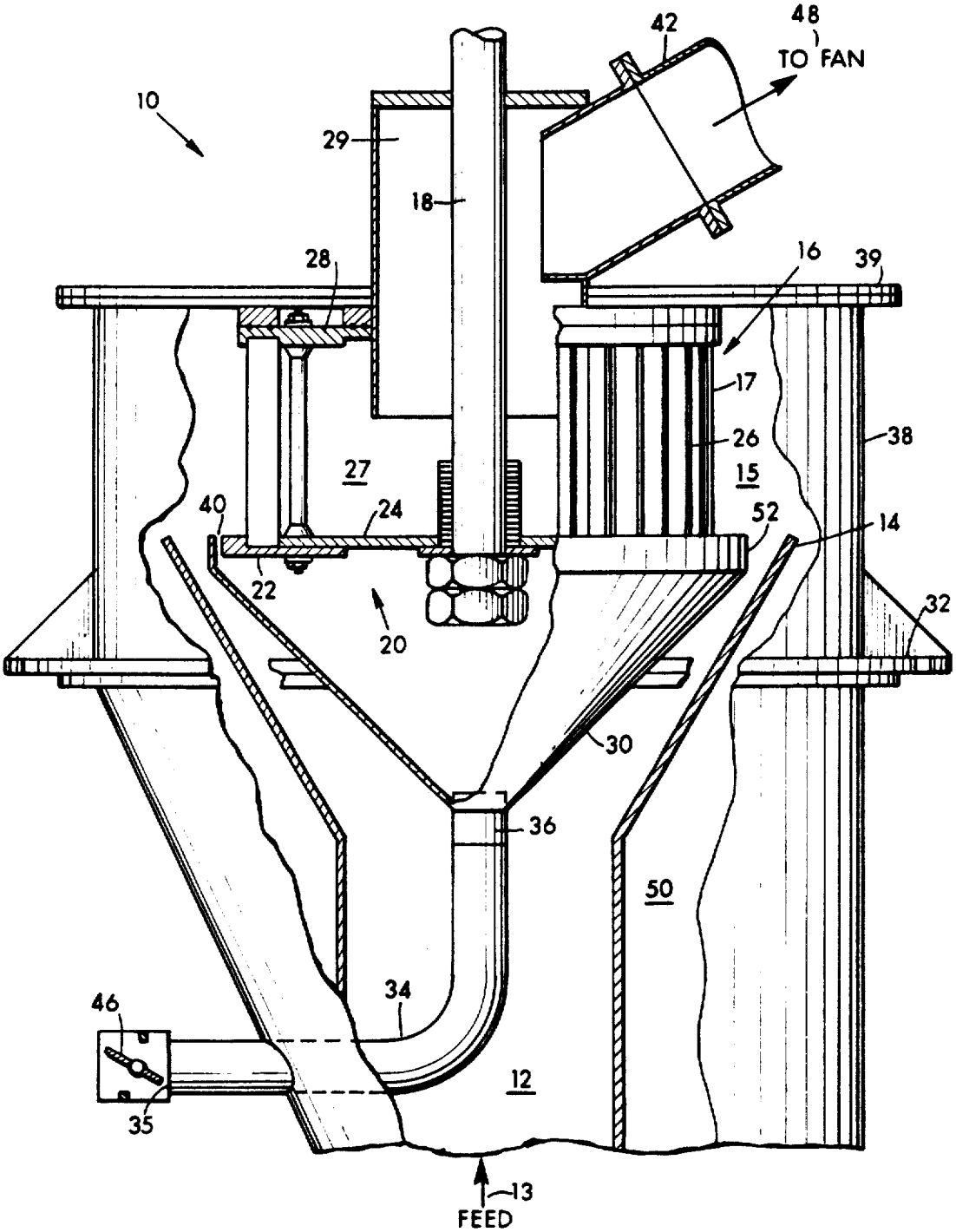
FIG. 1 is an elevational partially sectioned view of a first embodiment of apparatus in accordance with the present invention.

In FIG. 1 a plan, partially sectioned view appears of air classifying apparatus 10 in accordance with the present invention. The view is diagrammatic in nature and includes only a portion of the entire classifying system—only sufficient of the apparatus is shown as will enable full understanding of the present invention. Apparatus 10 is seen to include an outer classifying chamber 38. A conventional air classifier 16 is mounted within chamber 38 and includes a cage or rotor 17 which is rotatable about an axis 18 by means not shown. This type of cylindrical air classifier is well known in the art. The rotor 17 includes a plurality of rejector blades 26 which are mounted between an upper member 28 and a lower support plate 20, which consists of an outer piece 22 and an inner piece 24. The cage 17 is journaled for rotation about the vertical axis defined by member 18, as is known in the art. A feed flow channel 12 extends downwardly beneath classifier 16 and is defined by the outer wall 14. A particulate which is to be classified by apparatus 10 is provided as feed at 13 in the form of an air flow stream in which the particulate matter to be classified is entrained. So far this arrangement is conventional. In a typical application of apparatus of the present type, air classification of a mineral feed stream such as a kaolin clay may be accomplished by providing an upwardly directed air flow stream in channel 12, which passes into space 15 and then proceeds laterally i.e. in a radial direction into the interior of classifier 16. The rotating rejector blades 26 will act (again as is known in the art) to reject the coarser particles. The finer particles enter the interior space 27 of the classifier 16 where they then proceed outwardly via plenum 29 and duct 42 from which the stream is withdrawn by means of a fan 48 or other source of negative pressure. The fine materials thus classified are then collected for use. The coarser reject materials at the same time descend in the space 50 between feed channel 12 and the inner wall of classifying chamber 38. These coarser materials can comprise rejects for collection or discard, or can be recycled if desired with an intermediate step of grinding or the like being used to reduce the size of same.

Pursuant to prior art practice, the difficulty that has been inherent in apparatus of this type derives from the incessant impact of the particulate matter upon the lower support plate 20 which can occur in the absence of the present invention. The particulate matter or portions of same can be highly abrasive and such continued impact can over the course of time wear holes or cause fractures in the support plate, as a result of which the apparatus becomes inoperable and/or others parts of the rotatable cage 17 and/or the bearings for same can even suffer irreparable damage.

Pursuant to the present invention, it is seen that a deflector 30, comprised of any suitable abrasion resistant material, as for example a steel alloy or other suitable metal, is mounted within the feed channel 12, for example by the support structure 32. Deflector 30 is of generally frusto-conical or funnel shape, with the base of the cone being open and facing in an upward direction, and with the apex area being downwardly directed. The deflector 30 is hollow and the lower tapered end of same is connected via a duct attachment 36 to a conduit or duct 34. Duct 34 is open at its lower end 35 to enable its communication to atmosphere. A valve means 46 can be provided at the lower end in order to regulate the opening to atmosphere.

The deflector 30 is seen to be fixedly mounted, so that it is stationary. Toward the base of same, the frustum form is modified by an upwardly formed lateral wall or lip 52 which extends circumferentially completely around the base of deflector 30. The uppermost edge of lip 52 is approximately parallel to or slightly above the uppermost side of lower support plate 20, and the inner side of lip 52 is seen to be slightly spaced from the lateral edge of plate 20 to thereby define a slight gap 40 which again extends completely around the cage or rotor 17. In a typical construction where the diameter of deflector 30 at its base is 50 inches, the spacing of the gap 40 will be of the order of ⅛ inches. However, the actual spacing will vary in accordance with the dimensions of the device and the conditions under which the device is to be operated.

Pursuant to the present invention, it will be apparent that during operation of the classifier 16, an upwardly directed air flow proceeds in duct 12 by virtue of the suction maintained in the outlet duct 42 via fan 48. The pressure within space 15 will accordingly be below that of atmosphere. Accordingly, an outward air flow will be generated at the gap 40 as a result of the interior of the hollow deflector 30 being connected to atmosphere through duct 34. This outward flow through gap 40 provides an air seal which prevents particles from entering the interior of the deflector where they could interfere with the rotation of the classifier or damage the face plate by impact therewith.

Figure 2:
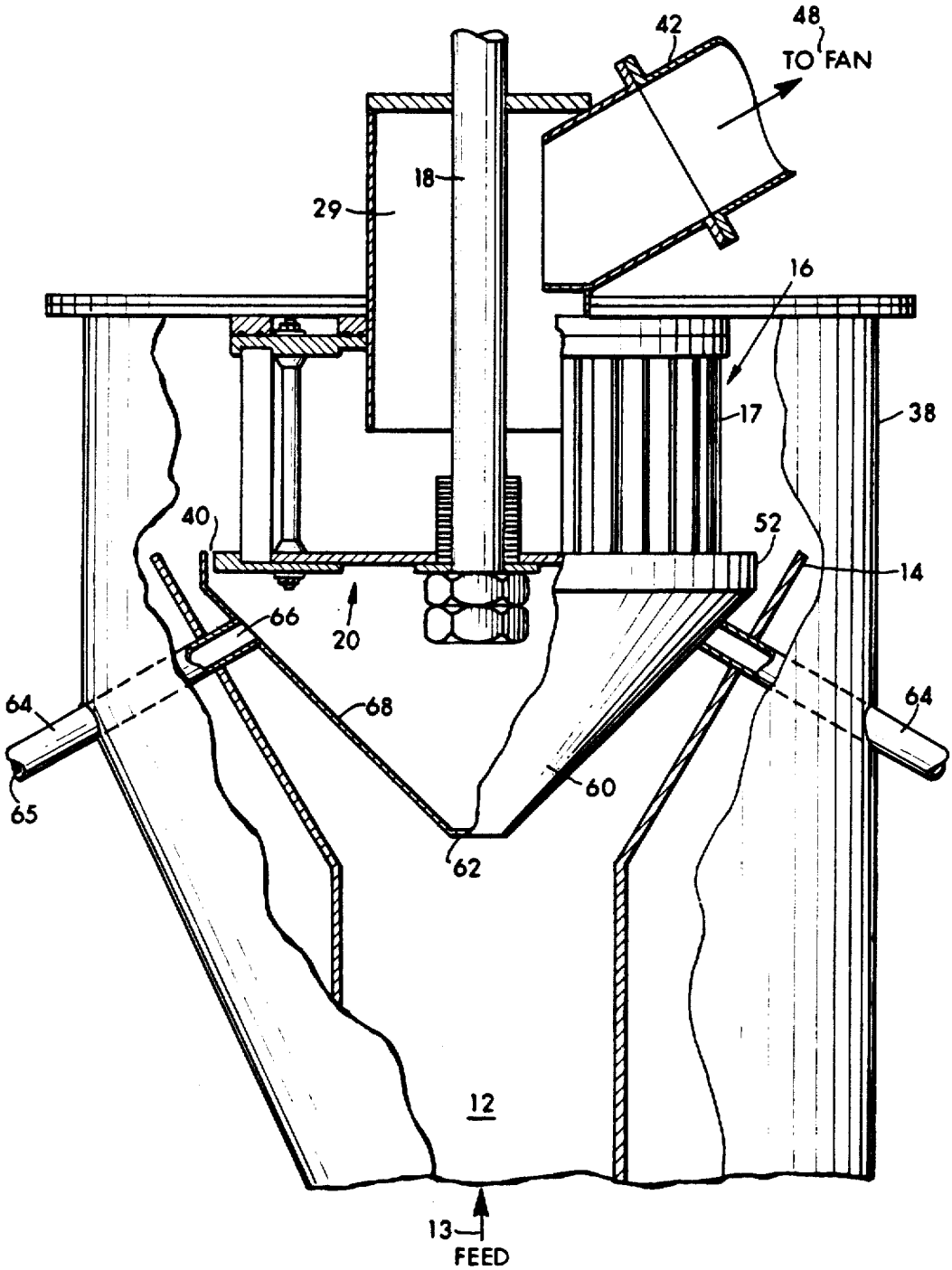
FIG. 2 is an elevational view similar to FIG. 1, and showing a further embodiment of apparatus in accordance with the present invention.

In FIG. 2, a second embodiment of apparatus in accordance with the invention appears. The view of FIG. 2 is similar in most respects to FIG. 1 and corresponding parts are similarly identified. The deflector 60 in FIG. 2, in general has the same characteristics as deflector 30 in FIG. 1. In this instance, however, deflector 30 is closed at its lower or apex end 62. The deflector 60 is supported within the apparatus, including within channel 12, by a series of hollow tubular members 64, each of which intersects with an opening 66 in the lateral wall 68 of deflector 60. Each of the tubular members 64 extend through wall 14 of channel 12 and through the wall of classifying chamber 38, so that the open distal ends 65 of these tubular members may communicate with atmosphere. In a typical arrangement pursuant to the invention, four such tubular members 64 may be utilized, which are located at four equidistant points about the periphery of the deflector 60. The said hollow tubular members serve a substantially identical function to that of conduit 34 in FIG. 1, i.e. they enable an air flow to be induced by a fan 48 into the hollow interior of deflector 60 so that the aforementioned air seal is enabled at the gap 40 between the deflector lip 52 and the lower support plate of rotor 17. The tubular members 64 may simultaneously serve as the support means for the deflector 60, although it is also possible to use support means in addition to or in place of the tubular members. Valve means of the type shown in FIG. 1 at 46 may be utilized as well with the tubular members 64 of the FIG. 2 embodiment. Alternatively, instead of relying upon induced air flow into the interior of the deflector 30 or 60 in FIGS. 1 and 2, an auxiliary means such as a compressor or fan may be employed to positively introduce pressure into the interior of deflector 30 to maintain the desired air seal.

While the present invention has been particularly set forth in terms of specific embodiments thereof, it will be understood in view of the instant disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

What is claimed is:

1. In apparatus for air classifying particles by size characteristics, said apparatus being of the type including a vertically oriented flow channel within an interior wall for carrying an upwardly directed air flow stream in which said particles are dispersed; a cylindrical air classifier mounted in said flow channel for rotation about a vertical axis, said classifier having a plurality of spaced vertical rejector blades mounted about its lateral periphery, and being substantially closed at its lower end by a support plate having a lateral edge; said classifier having an outlet connected to its interior for enabling particles passing radially through said blades to be withdrawn for collection; and air suction means connected to said classifier outlet for drawing said air stream and dispersed particles laterally into said classifier whereby said particles are size classified by passing through said rejector blades, and thereby establishing said upward flow of said air stream and dispersed particles within said channel;

THE IMPROVEMENT preventing or limiting damage of said classifier support plate by the abrasive impact of the said particles carried by said upward flow; comprising:

a hollow generally frusto-conically shaped deflector being fixedly mounted in said channel below said classifier with its apex facing downwardly; said deflector being open at its base, and having a cylindrical wall at its base, the inside of which surrounds but is spaced from the lateral edge of said support plate and the outside of the wall being spaced from the interior wall of said flow channel; and means for introducing an air flow into the hollow interior of said deflector at a pressure exceeding that in said flow channel to thereby effect an outward air flow through said space between said support plate edge and said cylindrical wall, to provide an air seal preventing particles from entering the interior of said deflector where they can interfere with the rotation of said classifier or damage the support plate by impact therewith.

2. Apparatus in accordance with claim 1, wherein said means for introducing an air flow into the hollow interior of said deflector comprises conduit means connecting said interior to atmosphere.

3. Apparatus in accordance with claim 1, wherein said means for introducing an air flow into the hollow interior of said deflector comprises means for generating a forced air flow into said deflector interior.

4. Apparatus in accordance with claim 2, wherein said conduit includes adjustable valve means for regulating the air flow into said deflector interior.

5. Apparatus in accordance with claim 5, wherein said conduit means comprise a plurality of hollow tubular members each of which intersects with an opening in the lateral wall of said deflector and communicates at its opposite end with atmosphere.

6. Apparatus in accordance with claim 5, wherein said tubular members support said deflector within said flow channel.

7. In apparatus for air classifying mineral particles by size, said apparatus including a vertically oriented flow channel for carrying an upwardly directed air flow stream in which said particles are dispersed; a cylindrical air classifier mounted in said flow channel and including a cage which is rotatable about a vertical axis; said cage being laterally open to said flow channel, having a plurality of spaced vertical rejector blades mounted about its lateral periphery, and being substantially closed at its lower end by a support plate having a lateral edge; an outlet connected to the classifier interior for withdrawing particles passing radially through said blades for collection; and air drawing means connected to said classifier outlet for drawing said air stream and particles into said classifier and thereby establishing said upward flow of said air stream and dispersed particles within said channel;

THE IMPROVEMENT preventing or limiting damage of said classifier cage support plate by the abrasive impact of the said particles carried by said upward flow; comprising:

a hollow funnel-shaped deflector being fixedly secured below said classifier with its tip facing downwardly; said deflector being open at its base, and formed thereat into an axially-extending lip, the inside of which surrounds but is slightly spaced from the lateral edge of said cage support plate; and means for inducing an outward air flow said space between said support plate edge and said deflector lip, to thereby provide an air seal preventing particles from entering the interior of said deflector where they can interfere with the rotation of said cage or damage said support plate.

8. Apparatus in accordance with claim 7, wherein said means for inducing said flow comprises means connecting said deflector interior to atmosphere.

9. Apparatus in accordance with claim 7, wherein said means for inducing said flow comprises means for generating a forced air flow into said deflector interior.

10. Apparatus in accordance with claim 8, wherein said means connecting said deflector interior to atmosphere includes adjustable valve means for regulating the air flow into said deflector interior.

* * * * *